US007287735B2

(12) United States Patent
Heerdt et al.

(10) Patent No.: US 7,287,735 B2
(45) Date of Patent: Oct. 30, 2007

(54) FIRE EXTINGUISHER BRACKET INCLUDING A LIVING HINGE

(75) Inventors: Dennis G. Heerdt, Garner, NC (US); Y. Christen Sperry, Graham, NC (US)

(73) Assignee: Walter Kidde Portable Equipment, Inc., Mebane, NC (US)

( * ) Notice: Subject to any disclaimer, the term of this patent is extended or adjusted under 35 U.S.C. 154(b) by 23 days.

(21) Appl. No.: 10/973,609

(22) Filed: Oct. 25, 2004

(65) Prior Publication Data

US 2006/0086876 A1 Apr. 27, 2006

(51) Int. Cl.
*A47K 1/08* (2006.01)

(52) U.S. Cl. ..... 248/311.2; 248/312; 248/312.1; 248/313; 169/51; 211/88.01; 24/3.1

(58) Field of Classification Search ..... 248/311.2, 248/312, 313, 312.1; 16/221; 169/51; 211/88.01, 211/86.01; 24/3.1, 68 R, 69 R, 68 F, 71 R, 24/339

See application file for complete search history.

(56) References Cited

U.S. PATENT DOCUMENTS

| | | | | | |
|---|---|---|---|---|---|
| 3,565,384 | A * | 2/1971 | Lockwood | 248/312 |
| D244,392 | S | 5/1977 | Montambo | D29/2 |
| D245,929 | S | 9/1977 | Montambo | D29/5 |
| D250,353 | S | 11/1978 | Avant | D29/2 |
| D250,776 | S | 1/1979 | Hard | D29/5 |
| 4,213,592 | A | 7/1980 | Lingenfelser | 248/313 |
| 4,304,383 | A * | 12/1981 | Huston | 248/313 |
| 4,505,448 | A | 3/1985 | Massie | 248/313 |
| 4,586,687 | A | 5/1986 | Ziaylek, Jr. | 248/313 |
| 4,905,950 | A | 3/1990 | Turner et al. | 248/313 |
| D307,494 | S | 4/1990 | Goodnight | D29/5 |
| 4,997,157 | A * | 3/1991 | Sweeny | 248/313 |
| 5,071,100 | A | 12/1991 | Sweeny | 248/313 |
| 5,100,007 | A | 3/1992 | Espasandin et al. | 211/71 |
| 5,344,112 | A * | 9/1994 | Peterson et al. | 248/313 |
| 5,354,029 | A * | 10/1994 | Ziaylek et al. | 248/313 |
| 5,362,022 | A | 11/1994 | McLoughlin et al. | 248/313 |
| D353,185 | S | 12/1994 | Mitchell | D23/206 |
| 5,533,701 | A | 7/1996 | Trank | 248/316.4 |
| 6,685,153 | B2 | 2/2004 | Foreman | 248/313 |
| 6,883,766 | B1 * | 4/2005 | Ziaylek et al. | 248/313 |
| 6,926,243 | B1 * | 8/2005 | Ziaylek et al. | 248/307 |
| 2004/0089459 | A1 | 5/2004 | Folks | 169/30 |

FOREIGN PATENT DOCUMENTS

| | | |
|---|---|---|
| GB | 1 428 319 | 3/1976 |
| GB | 2 205 733 A | 12/1988 |

* cited by examiner

*Primary Examiner*—Carl D. Friedman
*Assistant Examiner*—Todd M. Epps
(74) *Attorney, Agent, or Firm*—Merchant & Gould P.C.

(57) ABSTRACT

A mounting bracket having a living hinge operable to enable mounting straps of the mounting bracket to move between retracted and extended positions. In the extended position, the mounting straps are configured to extend around and retain a fire extinguisher. In the retracted position, the mounting straps are removed from the fire extinguisher. The living hinge may include a continuous piece of material that extends between the mounting straps and a base member of the mounting bracket to which the mounting straps are coupled.

15 Claims, 4 Drawing Sheets

10
12
14
16
18
20
22
28
30
34
36
38
40
42
50
52
54
56
60
62
68
72
74
78
80
81
90
$T_1$
$T_2$
$T_3$

FIRE EXTINGUISHER BRACKET INCLUDING A LIVING HINGE

BACKGROUND OF THE INVENTION

1. Field of the Invention

The present invention generally relates to brackets and mounting mechanisms for mounting a container to a wall structure, and more specifically relates to brackets for mounting cylindrical containers such as fire extinguishers to a wall structure.

2. Related Art

There are many types of containers in general use that are preferably mounted to a wall for convenient access. One such object is the common cylindrical shaped fire extinguisher. Fire extinguishers are available in many sizes and shapes. Many fire extinguishers are purchased with accompanying wall brackets that are intended to hold the extinguisher at a location selected by the user for greatest convenient in the case of an emergency fire. Many wall brackets include a base having a rear surface for engaging a wall to which the wall bracket is mounted, and a neck support coupled to the base that engages a neck or nozzle portion of the fire extinguisher. Some wall brackets also include some type of strap or other retaining member that is coupled to the base and extends around the main body portion of the fire extinguisher.

These types of wall brackets commonly have some disadvantages. For example, some wall brackets include multiple pieces that must be assembled together. A wall bracket with multiple pieces requires assembly costs and often higher manufacturing costs. Assembly of multiple pieces sometimes also sometimes involves problems with mating of the pieces. Other wall brackets do not properly retain the fire extinguisher in place with a positive attachment, or only loosely secure the fire extinguisher in place. Still other wall brackets are bulky in size and occupy undesirable amounts of space, in particular when the wall bracket is not holding a fire extinguisher. A bracket that addresses these and other shortcomings would be an advance in the art.

SUMMARY OF THE INVENTION

The present invention relates to a mounting bracket for fire extinguishers. One aspect of the invention relates to a mounting bracket having a living hinge operable to enable mounting straps of the mounting bracket to move between retracted and extended positions. In the extended position, the mounting straps are configured to extend around and retain a fire extinguisher. In the retracted position, the mounting straps are not configured to retain the fire extinguisher. The living hinge may include a continuous piece of material that extends between the mounting straps and a base member of the mounting bracket to which the mounting straps are coupled. The living hinge may include separate portions that individually couple the base to a given strap.

Another aspect of the invention relates to a fire extinguisher mounting bracket that includes a base, a strap member, and a hinge member. The base includes a top end and a bottom end and a length defined between the first and second ends. The strap member includes first and second strap ends that are disengagably coupled to each other. The hinge member is coupled between the base and strap member and enables movement of the strap member from a retracted position wherein the first and second strap ends extend in a direction parallel to the base length to an engagement position wherein the first and second strap ends extend in a direction substantially perpendicular to the base length. The strap member is configured to extend around a fire extinguisher positioned along the base length and retain the fire extinguisher to the base.

A further aspect of the invention relates to an apparatus for restraining an object that includes a base member having first and second ends, a receiver member coupled to the first end of the base member, and a retaining member including first and second strap members each having first and second ends. The first end of each strap members is coupled to the base member and the retaining member is movable between retracted and extended positions. The first and second strap members extend in a direction along a length of the base member when in the retracted position and extend in a direction substantially perpendicular to the base length when in the extended position. The second end of one strap member is configured for detachable coupling to the second end of the other strap member to restrain the object when the first and second strap members are in the extended position.

A yet further aspect of the invention relates to a method of manufacturing a fire extinguisher bracket that includes a base, a strap member, and a hinge. The method includes forming the base member with first and second ends and a thickness, forming the strap member with a thickness and first and second free ends, and coupling the hinge between the base member and the strap member. The hinge has a reduced thickness relative to the thicknesses of the base member and the strap member. The hinge member also provides pivotal movement of the strap member between a retracted position and an engagement position relative to the base member.

Yet another aspect of the invention relates to a method of securing a container to a mounting bracket. The method includes providing a base member, a strap, and a hinge, coupling the strap to the base with the hinge, moving the strap from a retracted position wherein the strap extends along a length of the base, to an engagement position wherein the strap extends in a substantially perpendicular direction to the base, positioning the container against the base, and extending the strap around the container to retain the container against the bracket.

The above summary of the present invention is not intended to describe each disclosed embodiment or every implementation of the present invention. In particular, the example embodiments described below in relation to the Figures are the application of the present invention for use with a fire extinguisher, whereas many other fields may be applicable to fulfill the purposes and intents of the present invention. Figures in the detailed description that follow more particularly exemplify certain embodiments of the invention. While certain embodiments will be illustrated and describe embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

DETAILED DESCRIPTION OF THE PREFERRED EMBODIMENT

The present invention relates to mounting brackets and more specifically relates to mounting brackets for cylindrical members such as fire extinguishers. One aspect of the invention relates to a bracket construction that includes a living hinge attachment of the bracket attachment strap to the base of the bracket. The living hinge permits the strap to move between a first position in which the strap cannot extend around the container to a second position in which the strap is able to extend around at least a portion of the circumference of the container. The use of a living hinge for the bracket also makes it possible to form the bracket as a single piece. Various methods may be used for forming the bracket such as, for example, injection molding and casting. Various materials may also be used for the bracket including, for example, polymer based materials.

Figure 3:
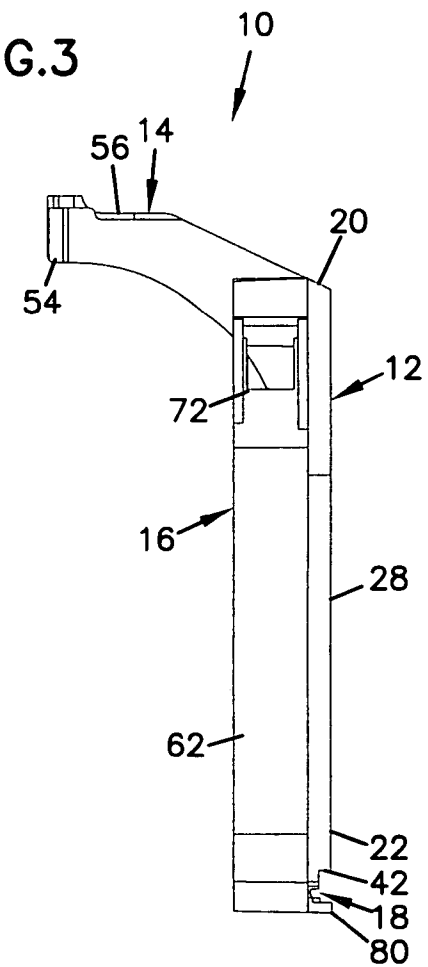
FIG. 3 is a right side view of the bracket shown in FIG. 1.
Figure 2:
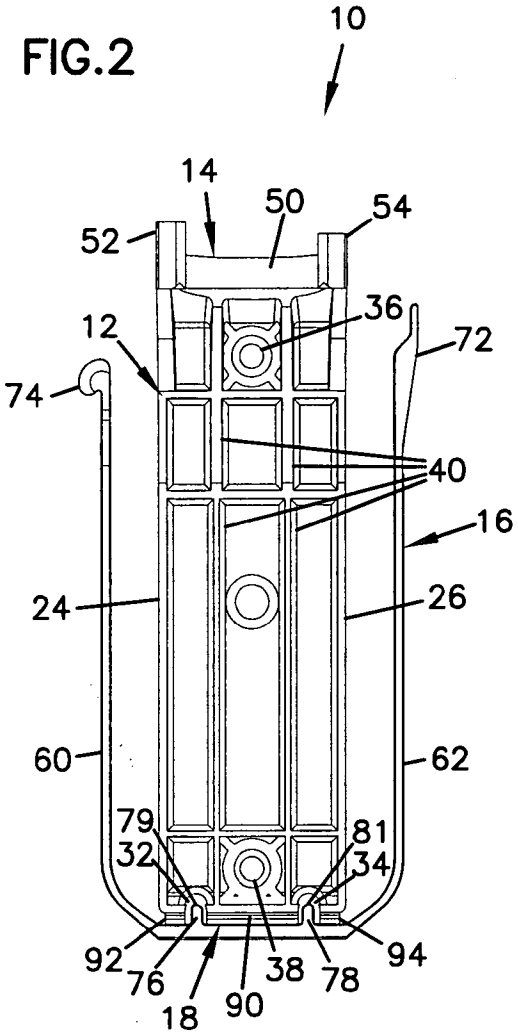
FIG. 2 is a front view of the bracket shown in FIG. 1.
Figure 1:
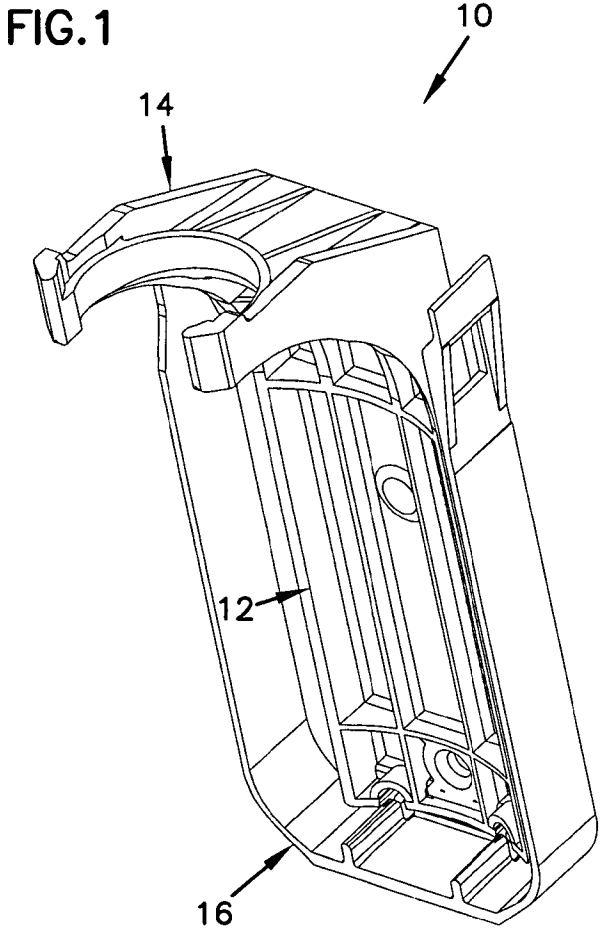
FIG. 1 is a front perspective view of an example fire extinguisher bracket according to principles of the present invention having a strap in the raised position.
Figures 4, 5, 6, 7:
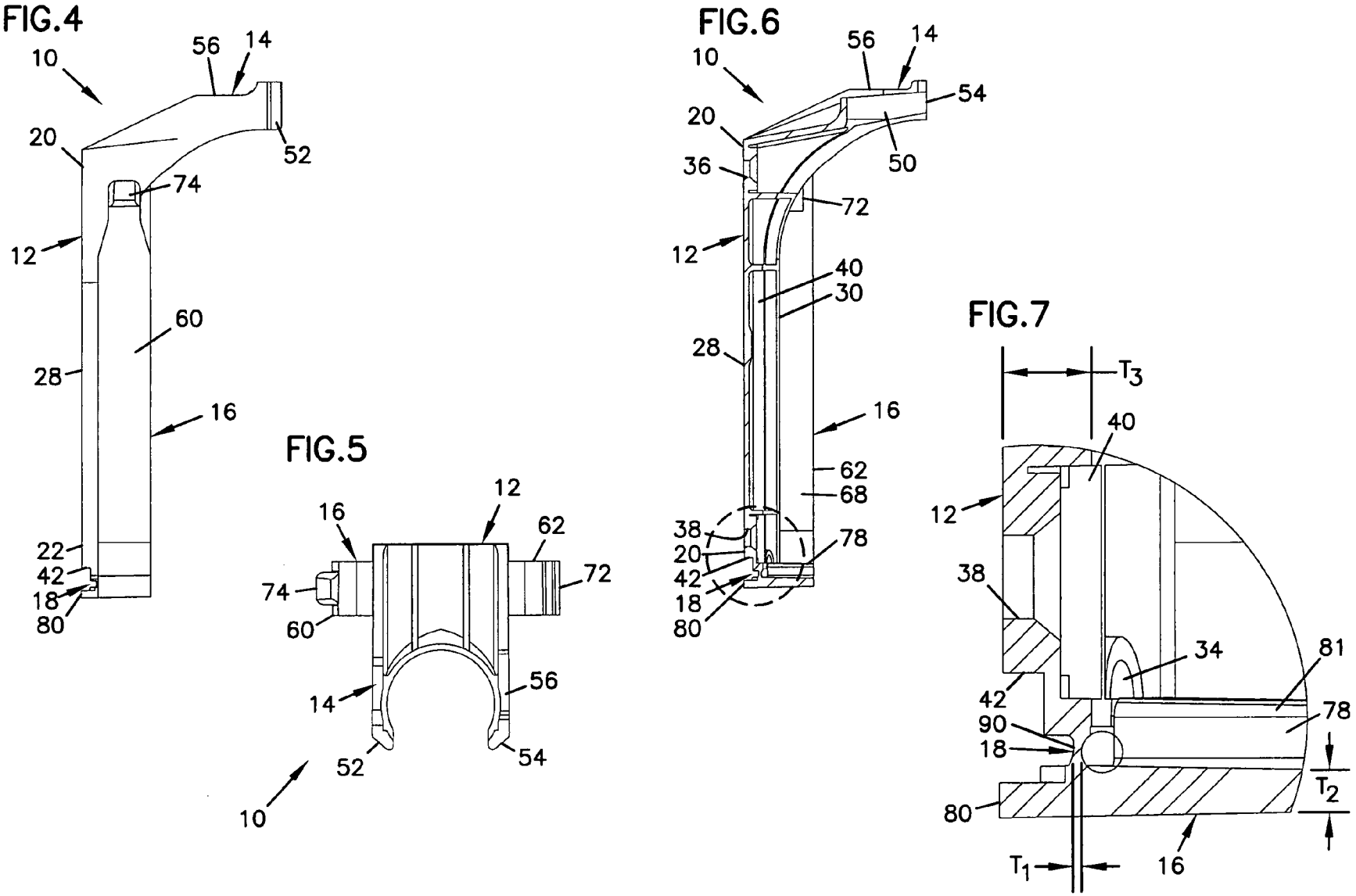
FIG. 4 is a left side view of the bracket shown in FIG. 1.
FIG. 5 is a top view of the bracket shown in FIG. 1.
FIG. 6 is a cross-sectional left side view of the bracket shown in FIG. 1.
FIG. 7 is a close-up view of the living hinge portion of the bracket shown in FIG. 6.
Figure 8:
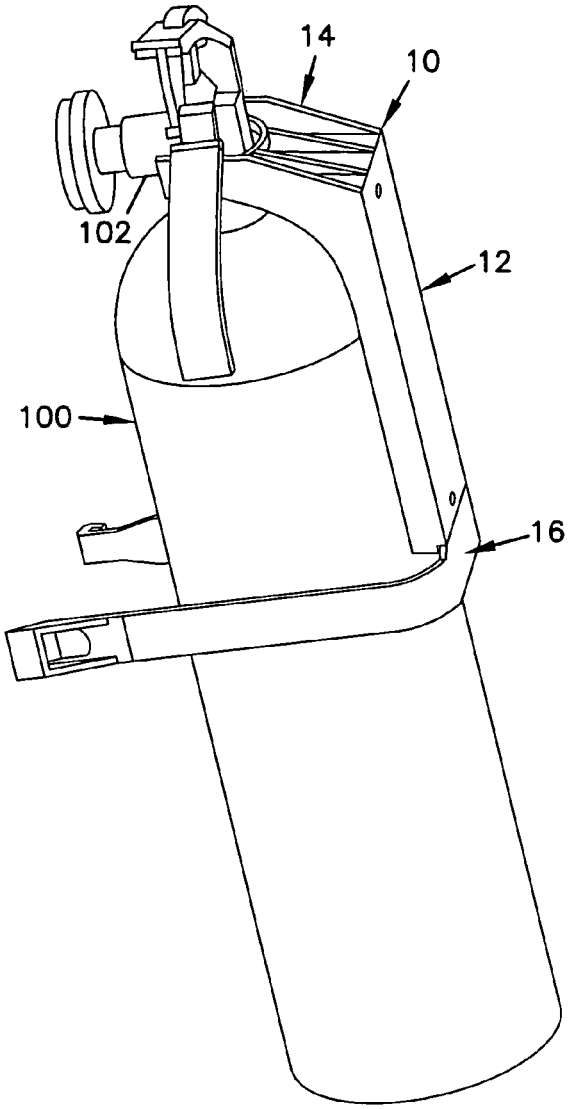
FIG. 8 is a rear perspective view of the bracket shown in FIG. 1 with the strap in the lowered position and an example fire extinguisher mounted to the bracket.
Figure 9:
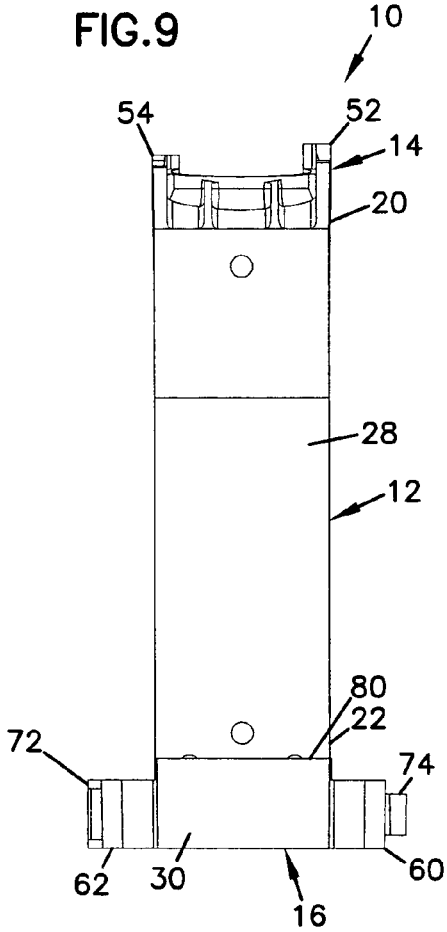
FIG. 9 is a rear view of the bracket shown in FIG. 8.
Figure 11:
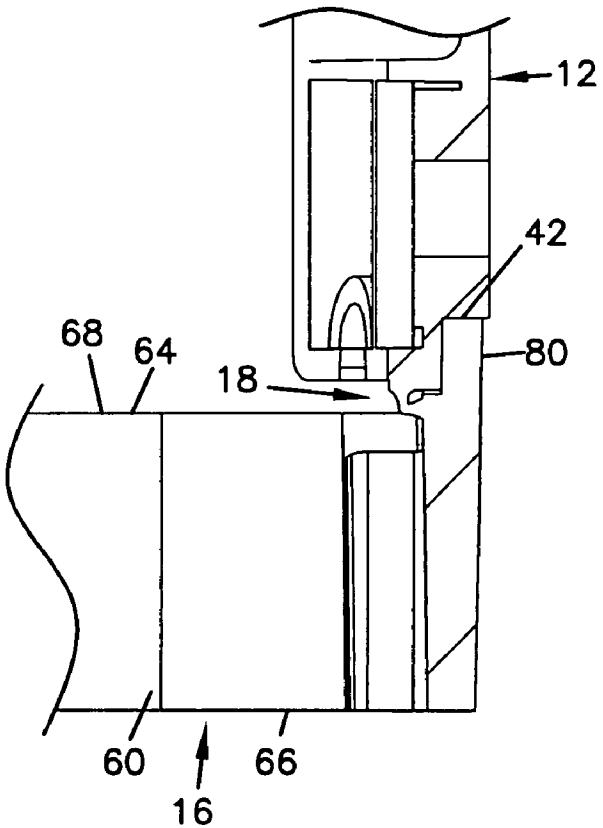
FIG. 11 is a close-up view of the living hinge portion of the bracket shown in FIG. 10.
Figure 10:
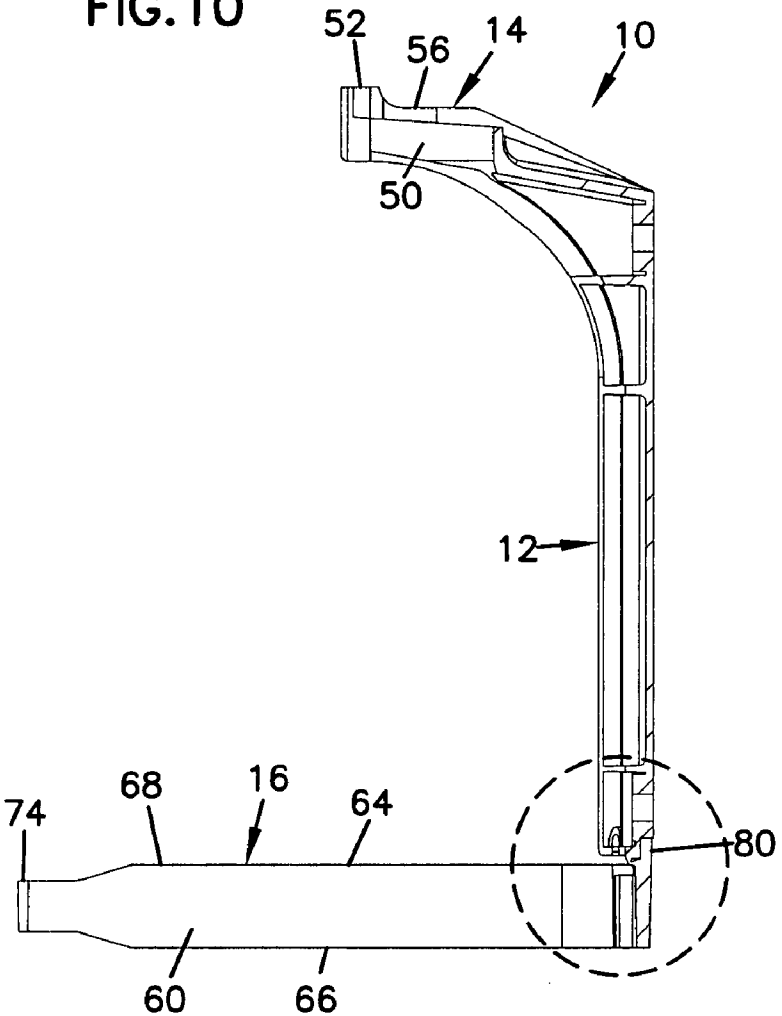
FIG. 10 is a cross-sectional right side view of the bracket shown in FIG. 8 with the strap in the lowered position.

Referring to FIGS. 1-11, an example mounting bracket 10 is shown and described. Bracket 10 includes a base 12, a neck support 14, a strap 16, and a living hinge 18. The living hinge provides for movement of the strap 16 relative to the base 12 such that the strap can move from a retracted position (see FIG. 1) to an engagement position (see FIG. 8). The living hinge also provides a secure attachment between the base 12 and the strap 16.

The base 12 includes top and bottom ends 20, 22, first and second sides 24, 26, a rear surface 28, and a front surface 30. The front surface 30 is defined in part by the first and second sides 24, 26 and also a plurality of structural ribs 40 that are exposed along the front surface 30. The front surface 30 may be generally contoured between the first and second sides 24, 26 to match a contoured surface of the container mounted to the bracket 10 (e.g., fire extinguisher 100 shown in FIG. 8). In some embodiments, the front surface 30 may be defined by a continuous piece of material rather than by the sides 24, 26 and ribs 40 as shown in the Figures.

The base 12 may also include top and bottom mounting apertures 36, 38 that are sized to receive a fastener. Fasteners extending through the apertures 36, 38 may be used to engage a wall structure or other support member to which the mounting bracket 10 is secured. Bracket 10 may include other means of attachment to a support structure rather than by fasteners that extend through apertures 36-38. Such alternative support means may include, for example, adhesives or securing features that are formed into and extend from the bracket.

Base 12 may also include first and second apertures 32, 34 positioned at the bottom end 22. A recess 42 may also be formed across the bottom end 22 along the rear surface 28. The recess 42 and apertures 32, 34 may be sized to accommodate features of the strap 16 as the strap moves between retracted and engagement positions as described in further detail below.

The neck support 14 defines a contoured support surface 50, first and second engagement members 52, 54 positioned at ends of the support surface 50, and an upper surface 56. The support surface 50 may be sized to engage a neck portion or a nozzle feature of a container such as a fire extinguisher (e.g., see FIG. 8). The upper surface 56 provides a support surface against which features of the container such as, for example, a nozzle, neck, cap or lid (e.g., the nozzle 102 shown in FIG. 8) may rest upon to hold the container in a fixed vertical position. The first and second engagement members 52, 54 are likewise configured to engage other features of the container such as, for example, the nozzle, neck, cap or lid to retain the upper portion of the container in a fixed lateral (front-to-back or side-to-side) position.

In other embodiments, the neck support 14 may include alternative features having different shapes and sizes than those shown in the figures. For example, the contoured support surface 50 may have a larger or smaller radius or may be positioned at a different distance from the base 12. The first and second engagement members 52, 54 are shown having different sizes and shapes in the Figures, whereas in other embodiments the engagement members may be mirror images of each other or only a single engagement member may be used.

In many applications, the neck support 14 retains the container so as to prevent the container from dropping vertically and restrict lateral movement of the upper portion of the container relative to the base 12. The bottom end of the container (that end of the container closer to the bottom end 22 of the base 12) may be able to move laterally side-to-side and front-to-back relative to the bottom end 22 even when the top of the container is retained by the neck support 14. The strap 16 is provided to reduce this freedom of movement at the bottom end of the container. The strap 16, when extended around the container establishes a two-point connection between the mounting bracket 10 and the container. In this way, the strap 16 functions as a retaining member.

The strap 16 includes first and second ends 60, 62, top and bottom sides 64, 66, and inside and outside surfaces 68, 70. A male connector 74 is positioned on the first end 60 and a female connector 72 is positioned on the second end 62. First and second support ribs 76, 78 are formed on the inside surface 68 and a stop member 80 is positioned along the top side 64. The support ribs 76, 78 may be sized to engage the outer surface of a container supported by bracket 10. The support ribs 76, 78 are sized and positioned to move into and out of the apertures 32, 34 in the base 12 as the strap 16 is moved between the retracted to the engagement positions shown in FIGS. 1 and 8, respectively. The support ribs 76, 78 may have a contoured surface 79, 81 for engaging the container when the strap 16 is in the engagement position shown in FIGS. 8-11.

The stop member 80 moves into and out of the recess 42 as the strap moves between retracted and engagement positions. The stop member 80 provides a stopping function that prevents the strap from rotating beyond a substantially 90° orientation relative to the base 12, as shown in FIGS. 8-11. The strap 16 is structured such that when the strap is in the engagement position shown in FIGS. 8-11, the strap 16 can provide a close fit around the container 100. The recess 42 and stop 80 may be configured differently in other embodiments to accommodate different container or strap configurations.

The strap 16 is coupled to the base 12 with the living hinge 18. The living hinge 18 includes a middle portion 90 and first and second side portions 92, 94. The middle portion 90 is positioned between the first and second aligning apertures 32, 34 and first and second support ribs 76, 78. The first and second side portions 92, 94 are positioned on opposite sides of the aligning apertures 32, 34 and support ribs 76, 78. The living hinge structure is continuous between the base 12 and strap 16. The living hinge 18 has a thickness T1 that is typically less than a thickness T2 of the strap 16 and a thickness T3 of the base 12 (see FIGS. 7 and 11). This reduced thickness provides relative flexibility as compared to the strap and base. Further, the absence of other structural features in the living hinge that would otherwise provide some stiffness also provides for a relatively pliable, flexible structure. Pliability and flexibility of the living hinge 18 enables the strap 16 to rotate relative to the base 12 while the strap 16 maintains a fixed connection to the base 12 via the living hinge 18.

In other embodiments, the strap may be at least partially divided into two or more portions (e.g., a separate strap member for each side of the container) and the living hinge 18 is divided into two or more portion that individually couple the strap portions to the base. Such a divided strap and divided living hinge may still have a continuous construction with the base such that the bracket is formed as a single piece.

The strap 16 is shown having a single female connector 72 and male connector 74 on opposing first and second ends 60, 62. In other embodiments, the strap may include multiple female or male connectors along a length of the strap so as to provide for mounting of various sized containers to the mounting bracket using the same strap member. In still further embodiments, the strap may be sized to extend from one side of the base all the way around the container to the other side of the base where the end of the strap is secured to the base. Any number of different strap configurations may be used in conjunction with the living hinge disclosed herein.

The living hinge 18 may include the same or similar materials to those materials used for the base 12 and strap 16. In some embodiments, the living hinge 18 may include a different material from the base and strap. The living hinge 18 may be molded at the same time using the same materials as used in the base 12 and strap 16. In other embodiments, the living hinge 18 may be made from a different material that is either preformed and separately coupled to the base 12 and strap 16 in a co-molding process, or may include material that is embedded in the continuous piece of material that extends from the base 12 to the strap 16.

The living hinge 18 is shown in the Figures as being positioned along the bottom end 22 of the base 12. In other embodiments, the strap 16 may be coupled to the base 12 via the living hinge 18 at a different position along the length of the base 12. For example, the base 12 can be modified with a cutout portion of the first and second sides 24, 26 and the support ribs 40 such that the strap 16 can be attached to the base at some position along the length of the base rather than at an end of the base 12. Any number of different configurations may be possible so long as the strap is coupled to the base with a living hinge that provides rotational motion of the strap relative to the base.

The example mounting brackets disclosed herein provide several advantages. When the bracket is formed of a continuous piece of material that extends from the base, to the living hinge, and to the strap, the bracket can be formed in a single manufacturing step such as, for example, molding using a moldable material. In other embodiments, some or all of the base, living hinge, and strap may be formed separately and then co-molded or otherwise formed integrally together.

The living hinge may also be altered in length and thickness to alter the position of the strap relative to the base. In some examples, the mounting bracket may include a biasing force applied, for example, by the living hinge or a separate biasing member, that biases the strap into the retracted position. By being biased into the retracted position, the strap will be removed out of the way when a container is not mounted to the bracket. This reduces the amount of space taken up by the bracket and reduces the bracket's potential for obstruction. In other embodiments, the biasing force may bias the strap towards the engagement position such that the bracket is better prepared for mounting the container. By moving the strap against the biasing force into the retracted position, the strap may be moved out of the engagement position only when a user explicitly does not want the strap in the engagement position. A separate retaining structure such as a clip or snap-fit connection may be provided to secure the strap against the base in the retracted position.

The example bracket shown and described herein may be used to mount or secure any type of container. When mounting the container, the strap may be moved from a retracted position in which the strap extends in a direction along the length of the base to an engagement position wherein the strap extends in a direction substantially normal to the length of the base. The container is brought into contact with the front surface of the base and the strap is extended around the container such that ends of the strap can be coupled to each other to retain the container against the bracket. The bracket may also include a neck support that engages an upper portion of the container to retain the container in a predetermined vertical position and retain the upper portion of the container in a fixed later position relative to the base of the bracket.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

We claim:

1. A fire extinguisher mounting bracket, the bracket comprising:

a base having a top end and a bottom end and a length defined between the first and second ends;

a strap member having first and second ends; and a hinge member coupled between the base and the strap member, the hinge member providing movement of the strap member from a retracted position wherein the first and second strap ends extend in a direction parallel to the base length to an engagement position wherein the first and second strap ends extend in a direction substantially perpendicular to the base length;

wherein the strap member is configured to extend around a fire extinguisher positioned along the base length and retain the fire extinguisher to the base.

2. The mounting bracket of claim 1, wherein the first and second ends of the strap member are configured to be disengagably coupled to each other.

3. The mounting bracket of claim 2, wherein the first and second ends of the strap member extend towards the top end of the base when in the retracted position.

4. The mounting bracket of claim 3, wherein the strap member is moveable through an angle of motion of about 90 degrees.

5. The mounting bracket of claim 1, wherein the base, strap member, and hinge member comprise a single, continuous piece of material.

6. The mounting bracket of claim 1, further comprising a neck mounting member having a recessed portion configured to engage a neck portion of the fire extinguisher, the neck mounting member being coupled to the top end of the base.

7. The mounting bracket of claim 1, wherein the strap member includes a stop member configured to restrict movement of the strap member beyond and angle of rotation between the retracted and engagement positions.

8. The mounting bracket of claim 1, wherein the hinge member has a thickness less than a thickness of the strap member.

9. The mounting bracket of claim 1, wherein the hinge member secures the strap member to the base while the strap member is moved between the retracted and extended positions, and wherein the strap member retains the fire extinguisher to the base.

10. An apparatus for restraining an object, the apparatus comprising:

a base member having first and second ends;

a receiver member coupled to the first end of the base member;

a retaining member including a strap member coupled to the base member, the retaining member being movable between retracted and extended positions; and a hinge member coupled between the base member and the retaining member to provide rotational movement of the retaining member between the retracted and extending positions;

wherein the strap member extends in a direction along a length of the base member when in the retracted position and extends in a direction substantially perpendicular to the base length when in the extended position, and the strap member is configured to extend around at least a portion of the object to retain the object against the base member when the strap member is in the extended position.

11. The apparatus of claim 10, wherein the strap member includes first and second strap portions each having first and second strap ends, the first end of each strap portion being coupled to the base member and the second end of one strap portion being configured for detachable coupling to the second end of the other strap portion when the strap member is in the extended position.

12. The apparatus of claim 10, wherein the retaining member is coupled to the second end of the base member.

13. The apparatus of claim 10, wherein the retaining member has a thickness and top and bottom edges, the top edge being oriented towards the first end of the base, and the top edge is coupled to the second end of the base.

14. The apparatus of claim 10, wherein the base, retaining member, and hinge members are formed as a single piece.

15. The apparatus of claim 10, wherein the hinge member secures the strap member to the base while the strap member is moved between the retracted and extended positions and when the strap member retains the object against the base.

* * * * *